United States Patent [19]

Craig, Jr.

[11] 4,284,598

[45] Aug. 18, 1981

[54] METHOD FOR MAKING BICOMPONENT FILAMENTS

[75] Inventor: James P. Craig, Jr., Decatur, Ala.

[73] Assignee: Monsanto Company, St. Louis, Mo.

[21] Appl. No.: 124,379

[22] Filed: Feb. 25, 1980

[51] Int. Cl.[3] ..... B29F 3/10

[52] U.S. Cl. ..... 264/171; 264/182; 425/464

[58] Field of Search ..... 425/131.5, 463, 464; 264/171, 182

[56] References Cited

U.S. PATENT DOCUMENTS

| | | | |
|---|---|---|---|
| 1,980,234 | 11/1934 | Taylor | 464/464 |
| 2,034,009 | 3/1936 | Taylor | 464/464 |
| 2,193,316 | 3/1940 | Ferkes | 464/464 |
| 2,370,765 | 3/1945 | Atwood | 464/464 |
| 3,217,734 | 11/1965 | Fitgerald | 264/171 |

*Primary Examiner*—Jay H. Woo

*Attorney, Agent, or Firm*—Robert L. Broad, Jr.; John W. Whisler

[57] ABSTRACT

The method for making bicomponent filaments from two spin dopes wherein the dopes are assembled into alternating layers in a feed tube leading to a transition tube connected to a conventional spinnerette, the layers then being fed through the transition tube and the spinnerette to form filaments. The feed tube has a constant cross-sectional area along the length thereof and the transition tube has a parabolic configuration such that the linear flow rate of the assembled dope layers passing through the transition tube decreases at a uniform rate as the cross-sectional area of the stream of assembled layers is increased to the cross-sectional area of the spinnerette, to thereby maintain the distinctness of the interfaces of the layers and thus insure that good bicomponent filaments will be formed.

5 Claims, 4 Drawing Figures

METHOD FOR MAKING BICOMPONENT FILAMENTS

BACKGROUND OF THE INVENTION a. Field of the Invention

This invention relates to methods for producing bicomponent acrylic filaments.

b. Description of the Prior Art

It is known to form bicomponent acrylic filaments by assembling alternating layers of two different spin dopes in a tube and then feeding the assembled layers to a conventional spinnerette to form filaments. The spinnerette has a larger cross-sectional area than the tube through which the layers are fed and, to expande the cross-sectional area of the assembly of layers to the cross-sectional area of the spinnerette, the spinnerette is connected to the tube by a short tube having a conical configuration. When a relatively small spinnerette is used, the interfaces between adjacent layers of the spin dope retain their integrity to a degree such that bicomponent filaments are formed, a bicomponent filament being formed at each point where an interface between two adjacent layers intersects a hole in the spinnerette.

It has been found that this method is unacceptable where a fairly large spinnerette is used. The conical tube connected between the feed tube and the spinnerette expands the cross-sectional area of the stream in such a manner that the layers become sufficiently mixed at the interfaces that good bicomponent fibers cannot be formed.

It has been found that little or no mixing of adjacent layers at the interface therebetween will occur when the transition tube between the feed tube and the spinnerette has a parabolic configuration.

SUMMARY OF THE INVENTION

The method for making bicomponent filaments wherein alternating layers of two or more spin dopes are assembled in a feed tube which leads through a transition tube to a spinnerette having a larger diameter than the feed tube. The transition tube has a parabolic configuration such that the interfaces between adjacent layers of spin dope remain sufficiently distinct, as the cross-sectional area of the mass of spin dopes is expanded from the tube to the spinnerette, that good bicomponent fibers are made.

DETAILED DESCRIPTION OF THE INVENTION

Figure 1:
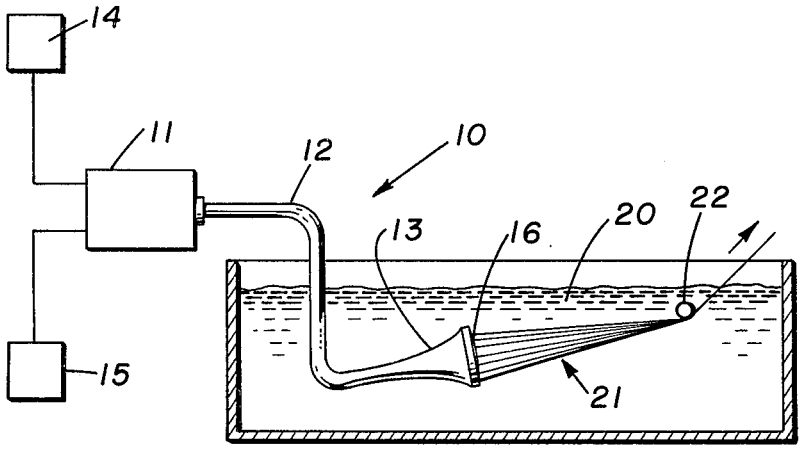
FIG. 1 is a schematic side view of apparatus used in carrying out the process of the present invention.

Referring now in detail to the drawings, there is shown a system 10 (FIG. 1) for spinning bicomponent filaments from spin dopes made up of acrylonitrile copolymers dissolved in a suitable solvent such as dimethylacetamide. Acrylonitrile polymers and copolymers and methods of wet spinning them are well known to those skilled in the art.

Figure 2:
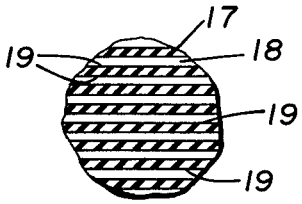
FIG. 2 is a cross-sectional view showing the manner in which the spin dopes are assembled in layers in the feed tube.
Figure 3:
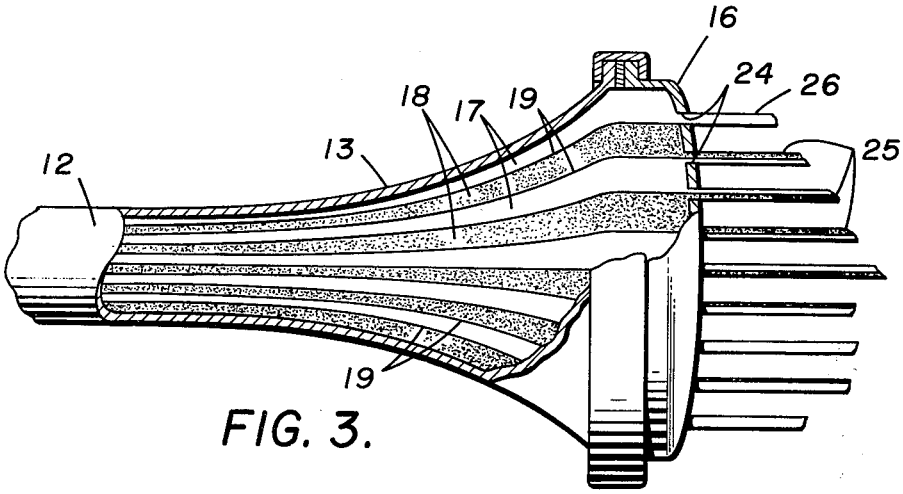
FIG. 3 is an enlarged cross-sectional view of the transition tube used in the process of the present invention, showing the parabolic configuration of this tube.

The system 10 includes a device 11 which serves to assemble two or more spin dopes in a feed tube 12 in alternating layers to form a mass which fills the feed tube. The device 10 is described and claimed in U.S. Pat. No. 3,295,552. The spin dopes are fed from supplies 14 and 15 and the device 11 assembles the spin dopes in the feed tube 12 in alternating layers 17 and 18 having interfaces 19, as best shown in FIGS. 2 and 3. The feed tube 12 has a constant diameter along its length and its inner wall is smooth and free of any joints which would tend to disrupt the laminar flow of the mass of spin dope.

The feed tube 12 is connected to a transition tube 13 leading to a conventional spinnerette 16 submerged in a spinbath 20 made up of a mixture of water and a solvent such as dimethylacetamide. A bundle 21 of filaments formed by the spinnerette pass through the water/solvent mixture 20 under a guide bar 22 and out of the spinbath for further processing. Spin dopes and method of making and spinning them are well known to those skilled in the art.

At each point where one of the interfaces 19 intersects a hole 24 in the spinnerette 16, a bicomponent filament 25 will be formed (FIG. 3). At those holes 24 in the spinnerette where no interface 19 intersects the hole, a monocomponent filament 26 will be formed. In the filament bundle leaving the spinnerette, most of the filaments will be bicomponent filaments.

The layers 17 and 18 are very thin, so that a large proportion of bicomponent fibers will be formed. In one run, the feed tube had a diameter of 2.7 cm, the spinnerette had a diameter of 13.3 cm and the mass of spin dope in the feed tube 12 was made up of 210 layers.

The transition element 13 is provided with a parabolic flare as best shown in FIG. 3 to expand the cross-sectional area of the mass of assembled layers of spinning dope from the cross-sectional area of the feed tube 12 to the cross-sectional area of the spinnerette 16. The flare in the transition tube 13 is parabolic in nature and has a configuraton such that the linear flow rate of the spinning dopes through the transition tube 13 decreases at a uniform rate along the tube 13. This occurs because the cross-sectional area of the transition tube increases directly with the distance from the inlet end of the tube. This retains the distinctness of the interfaces 19 sufficiently that good bicomponent filaments are formed.

Figure 4:
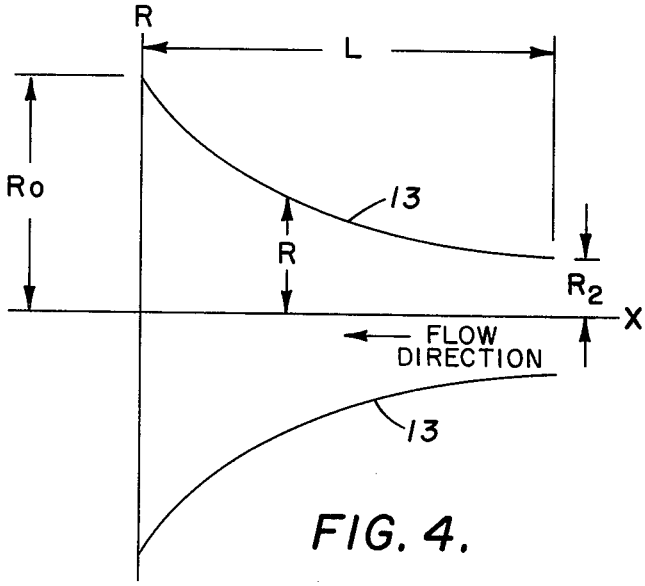
FIG. 4 is a drawing showing dimensions used to determine the equation for the parabolic configuration of the transition tube.

FIG. 4 shows dimensions used in determining the equation for the parabolic curve of the transition tube 13. This curve is represented by the equation $$R = \frac{R_o}{\left[\left(\frac{R_o^2}{R_2^2} - 1\right)\frac{X}{L} + 1\right]^{\frac{1}{2}}}$$

where the X extends the axis of the transition tube and the R axis lies on a diameter of the large end of the tube, (X,R) are the coordinates of points on the parabolic curve, with X being the distance of the point from the exit or large end of the transition tube and R being the radius of the tube at this point. $R_o$ is the radius of the large, or exit, end of the transition tube. $R_2$ is the radius of the small, or inlet, end of the transition tube, and L is the length of the transition tube. The configuration of the transition tube causes the linear flow rate of the mass of assembled layers to decrease at a uniform rate as the layers pass through the transition tube.

In carrying out the process of the invention, two or more spin dopes are fed to the device 11 which assembles the dopes in alternating layers in a mass in the feed tube 12. The interfaces 19 between the layers 17 and 18 remain distinct even though the spinning dopes are passed through bends in the feed tube 12. The layered spin dopes pass through the transition tube 13 and the spinnerette 16 to form a bundle 21 of filaments, most of which are bicomponent. The parabolic flare in the transition tube 13 expands the cross-sectional area of the dope mass from that of the area of the feed tube 12 to the area of spinnerette 16 while retaining the distinctness of the interfaces 19 between the adjacent layers of spin dope.

What is claimed is:

1. The method of making bicomponent filaments from two different spin dopes, comprising a. assembling said dopes into alternating layers in a feed tube connected to a transition tube leading to a spinnerette having a diameter greater than the diameter of the tube;

b. and feeding the dope layers from the feed tube through the transition tube and the spinnerette to form filaments, said transition tube having a parabolic configuration such that the linear rate of flow of the dope layers through said transition tube decreases at a uniform rate along the length of the transition tube.

2. The method of claim 1 wherein the feed tube has a uniform cross-sectional area along the length thereof so that the polymer flow rate is constant along the length of said feed tube.

3. The process of claim 2 wherein the parabolic configuration of the transition tube is defined by the equation $$R = \frac{R_o}{\left[\left(\frac{R_o^2}{R_2^2} - 1\right)\frac{X}{L} + 1\right]^{\frac{1}{2}}}$$

where the X axis extends along the axis of the transition tube and the R axis lies on a diameter of the large end of the tube, (X,R) are the coordinates of points on the parabolic curve, with X being the distance of the point from the exit or large end of the transition tube and R being the radius of the tube at this point, $R_o$ is the radius of the large, or exit, end of the transition tube, $R_2$ is the small, or inlet, end of the transition tube, and L is the length of the transition tube.

4. The method of claim 3 where $R_2$ is the radius of the feed tube.

5. The method of making bicomponent filaments from a plurality of different spin dopes, comprising a. assembling the spin dopes into alternating layers in a feed tube, said tube being connected to a transition tube leading to a spinnerette.

b. and feeding the dope layers through the transition tube and the spinnerette to form filaments, said transition tube having a cross-sectional area which increases directly with the distance from the inlet end of said transition tube to decrease the linear flow rate of the assembled layers at a uniform rate.

* * * * *